US011524474B2

(12) United States Patent
Pettersson et al.

(10) Patent No.: US 11,524,474 B2
(45) Date of Patent: Dec. 13, 2022

(54) ADJUSTABLE CUTTING AND CREASING HEADS FOR CREATING ANGLED CUTS AND CREASES

(71) Applicant: Packsize LLC, Salt Lake City, UT (US)

(72) Inventors: Niklas Pettersson, Västerås (SE); Johan Blomberg, Uppsala (SE); Bjorn Thunell, Örsundsbro (SE)

(73) Assignee: PACKSIZE LLC, Salt Lake City, UT (US)

( * ) Notice: Subject to any disclaimer, the term of this patent is extended or adjusted under 35 U.S.C. 154(b) by 325 days.

(21) Appl. No.: 16/689,976

(22) Filed: Nov. 20, 2019

(65) Prior Publication Data

US 2020/0171778 A1 Jun. 4, 2020

Related U.S. Application Data

(60) Provisional application No. 62/773,484, filed on Nov. 30, 2018.

(51) Int. Cl.
*B31D 1/00* (2017.01)
*B31B 50/20* (2017.01)
(Continued)

(52) U.S. Cl.
CPC ..... *B31D 1/0043* (2013.01); *B31B 50/20* (2017.08); *B31B 50/25* (2017.08); *B31B 50/26* (2017.08); *B31B 2120/302* (2017.08)

(58) Field of Classification Search
CPC ..... B31D 1/0043; B31B 50/20; B31B 50/25; B31B 50/26; B31B 2120/302
See application file for complete search history.

(56) References Cited

U.S. PATENT DOCUMENTS 2,077,428 A 4/1937 Robert
2,083,351 A 7/1937 Sidebotham
(Continued)

FOREIGN PATENT DOCUMENTS

CN 2164350 5/1994
CN 1191833 9/1998
(Continued)

OTHER PUBLICATIONS

International Search Report and Written Opinion received for PCT Patent Application No. PCT/US2019/062696, dated Feb. 27, 2020, 10 pages.
(Continued)

*Primary Examiner* — Joshua G Kotis
*Assistant Examiner* — Scott A Howell
(74) *Attorney, Agent, or Firm* — Workman Nydegger

(57) ABSTRACT

A converting machine is used to convert sheet material into packaging templates for assembly into boxes or other packaging. The converting machine includes a converting assembly that performs a transverse conversion function, a longitudinal conversion function, and an angled conversion function on the sheet material to create the packaging templates. The converting machine includes a tool head with a converting instrument. The orientation of the converting instrument is adjustable to enable performance of the angled conversion function and at least one of the longitudinal conversion function and the transverse conversion function.

29 Claims, 5 Drawing Sheets

(51) Int. Cl.

| | |
|---|---|
| ***B31B 120/30*** | (2017.01) |
| ***B31B 50/26*** | (2017.01) |
| ***B31B 50/25*** | (2017.01) |

(56) References Cited

U.S. PATENT DOCUMENTS 2,181,117 A 11/1939 Brenn
2,256,082 A 9/1941 Feurt
2,449,663 A 9/1948 Marcalus
2,609,736 A 9/1952 Montgomery
2,631,509 A 3/1953 Whytlaw
2,679,195 A 5/1954 Whytlaw
2,699,711 A 1/1955 Mobley
2,798,582 A 7/1957 Monroe
3,096,692 A 7/1963 Crathern et al.
3,105,419 A 10/1963 La Bombard
3,108,515 A 10/1963 Stohlquist
3,303,759 A 2/1967 Burke
3,418,893 A 12/1968 Stohlquist
3,469,508 A 9/1969 Klapp
3,511,496 A 5/1970 Zoglmann
3,566,755 A 3/1971 Smith et al.
3,618,479 A 11/1971 Shields
3,628,408 A 12/1971 Rod et al.
3,646,418 A 2/1972 Sterns et al.
3,743,154 A 7/1973 Brewitz
3,776,109 A 12/1973 Clark et al.
3,803,798 A 4/1974 Clancy
3,804,514 A 4/1974 Jasinski
3,807,726 A 4/1974 Hope
3,882,764 A 5/1975 Johnson
3,891,203 A 6/1975 Schiff
3,912,389 A 10/1975 Miyamoto
3,913,464 A 10/1975 Flaum
3,949,654 A 4/1976 Stehlin
4,033,217 A 7/1977 Flaum et al.
4,044,658 A 8/1977 Mitchard
4,052,048 A 10/1977 Shirasaka
4,056,025 A 11/1977 Rubel
4,094,451 A 6/1978 Wescoat
4,121,506 A 10/1978 Van Grouw
4,123,966 A 11/1978 Buschor
4,164,171 A 8/1979 Meyers et al.
4,173,106 A 11/1979 Garcia et al.
4,191,467 A 3/1980 Schieck
4,224,847 A 9/1980 Tokuno
4,261,239 A 4/1981 Toboshi et al.
4,264,200 A 4/1981 Tickner
4,295,841 A 10/1981 Ward, Jr.
4,320,960 A 3/1982 Ward et al.
4,368,052 A 1/1983 Bitsky et al.
4,373,412 A 2/1983 Gerber et al.
4,375,970 A 3/1983 Murphy
4,401,001 A * 8/1983 Gerber ..... B26D 1/185 83/451
4,449,349 A 5/1984 Roth
4,487,596 A 12/1984 Livens et al.
4,563,169 A 1/1986 Virta et al.
D286,044 S 10/1986 Kando
4,638,696 A 1/1987 Urwyler
4,695,006 A 9/1987 Pool
4,714,946 A 12/1987 Bajgert
4,743,131 A 5/1988 Atwell
4,749,295 A 6/1988 Bankier
4,773,781 A 9/1988 Bankier
4,838,468 A 6/1989 Lesse
4,847,632 A 7/1989 Norris
4,878,521 A 11/1989 Fredrickson
4,887,412 A 12/1989 Takamura
4,923,188 A 5/1990 Neir
4,932,930 A 6/1990 Coalier et al.
4,979,932 A 12/1990 Burnside
5,005,816 A 4/1991 Stemmler
5,039,242 A 8/1991 Johnson
5,046,716 A 9/1991 Lippold
5,058,872 A 10/1991 Gladow
5,072,641 A 12/1991 Urban et al.
5,081,487 A 1/1992 Hoyer
5,090,281 A 2/1992 Paulson
5,111,252 A 5/1992 Hamada
5,118,093 A 6/1992 Makiura
5,120,279 A 6/1992 Adami
5,123,890 A 6/1992 Green
5,123,894 A 6/1992 Bergeman
5,137,172 A 8/1992 Wagner
5,137,174 A 8/1992 Bell
5,197,366 A 3/1993 Paulson
5,240,243 A 8/1993 Gompertz
5,241,353 A 8/1993 Maeshima
5,263,785 A 11/1993 Negoro
D344,751 S 3/1994 Keong
5,321,464 A 6/1994 Jessen
2,353,419 A 7/1994 Smithson
5,335,777 A 8/1994 Murphy
5,358,345 A 10/1994 Damitio
5,369,939 A 12/1994 Moen et al.
5,375,390 A 12/1994 Frigo et al.
5,411,252 A 5/1995 Lowell
5,584,633 A 12/1996 Scharer
5,586,758 A 12/1996 Kimura
5,624,369 A * 4/1997 Bidlack ..... B31B 50/00 493/355
5,671,593 A 9/1997 Ginestra et al.
5,716,313 A 2/1998 Sigrist et al.
5,727,725 A 3/1998 Paskvich
5,836,498 A 11/1998 Turek
5,902,223 A 5/1999 Simmons
5,927,702 A 7/1999 Ishii
5,941,451 A 8/1999 Dexter
5,964,686 A * 10/1999 Bidlack ..... B26D 1/185 493/160
6,000,525 A 12/1999 Frulio
6,164,045 A 12/2000 Focke
6,189,933 B1 2/2001 Felderman
6,245,004 B1 6/2001 Waters
6,321,650 B1 11/2001 Ogawa
6,397,557 B1 6/2002 Bassissi
6,428,000 B1 8/2002 Hara
6,471,154 B2 10/2002 Zsolt
6,553,207 B2 4/2003 Tsusaka
6,568,865 B1 5/2003 Fujioka
6,830,328 B2 12/2004 Cuyler, Jr.
6,837,135 B2 1/2005 Michalski
6,840,898 B2 1/2005 Pettersson
6,968,859 B1 11/2005 Nagano et al.
7,100,811 B2 9/2006 Pettersson
7,121,543 B2 10/2006 Fujioka
7,237,969 B2 7/2007 Bartman
7,637,857 B2 12/2009 Coullery et al.
7,641,190 B2 1/2010 Hara
7,647,752 B2 1/2010 Magnell
7,648,451 B2 1/2010 Calugi
7,648,596 B2 1/2010 Sharpe et al.
7,690,099 B2 4/2010 Bapst et al.
7,849,776 B2 * 12/2010 Hilgendorf ..... B65B 59/02 83/495
7,997,578 B2 8/2011 Saito
D703,246 S 4/2014 Pettersson et al.
9,120,284 B2 9/2015 Capoia
9,199,794 B2 12/2015 Nadachi et al.
9,329,565 B2 5/2016 Osaki
9,352,526 B2 5/2016 Pettersson et al.
9,969,142 B2 5/2018 Pettersson et al.
10,093,438 B2 10/2018 Pettersson
10,954,018 B2 * 3/2021 Benterman ..... B31F 1/10
11,027,510 B2 * 6/2021 Fukuda ..... B31B 50/006
2002/0017754 A1 2/2002 Kang
2002/0066683 A1 6/2002 Sanders
2002/0091050 A1 7/2002 Bacciottini
2002/0115548 A1 8/2002 Lin et al.
2002/0125712 A1 9/2002 Felderman
2002/0139890 A1 10/2002 Toth
2003/0102244 A1 6/2003 Sanders
2003/0217628 A1 11/2003 Michalski

(56) References Cited

U.S. PATENT DOCUMENTS

| | | | | |
|---|---|---|---|---|
| 2004/0060264 | A1 | 4/2004 | Miller | |
| 2004/0082453 | A1 | 4/2004 | Pettersson | |
| 2004/0092374 | A1 | 5/2004 | Chiu-Fu | |
| 2004/0261365 | A1 | 12/2004 | White | |
| 2005/0079965 | A1 | 4/2005 | Moshier et al. | |
| 2005/0103923 | A1 | 5/2005 | Pettersson | |
| 2005/0215409 | A1 | 9/2005 | Abramson et al. | |
| 2005/0280202 | A1 | 12/2005 | Vila | |
| 2006/0180991 | A1 | 8/2006 | Nakahata et al. | |
| 2006/0181008 | A1 | 8/2006 | Van Gerven | |
| 2007/0079575 | A1 | 4/2007 | Monti | |
| 2007/0125212 | A1* | 6/2007 | Hilgendorf | B26D 7/0625 83/408 |
| 2007/0228119 | A1 | 10/2007 | Barner | |
| 2007/0287623 | A1 | 12/2007 | Carlson | |
| 2007/0289253 | A1 | 12/2007 | Miller | |
| 2008/0020916 | A1 | 1/2008 | Magnell | |
| 2008/0066632 | A1 | 3/2008 | Raueiser | |
| 2008/0115641 | A1* | 5/2008 | Freyburger | B26D 3/10 83/425.2 |
| 2008/0148917 | A1 | 6/2008 | Pettersson | |
| 2008/0300120 | A1 | 12/2008 | Sato | |
| 2009/0062098 | A1 | 3/2009 | Inoue et al. | |
| 2009/0178528 | A1 | 7/2009 | Adami | |
| 2009/0199527 | A1 | 8/2009 | Wehr et al. | |
| 2010/0041534 | A1 | 2/2010 | Harding | |
| 2010/0111584 | A1 | 5/2010 | Shiohara | |
| 2011/0026999 | A1 | 2/2011 | Kohira | |
| 2011/0092351 | A1 | 4/2011 | Hatano | |
| 2011/0099782 | A1 | 5/2011 | Schonberger | |
| 2011/0110749 | A1 | 5/2011 | Carter et al. | |
| 2011/0171002 | A1 | 7/2011 | Pettersson | |
| 2011/0229191 | A1 | 9/2011 | Nomi | |
| 2011/0230325 | A1 | 9/2011 | Harding et al. | |
| 2011/0319242 | A1 | 9/2011 | Pettersson | |
| 2012/0021884 | A1 | 1/2012 | Musha | |
| 2012/0129670 | A1 | 5/2012 | Pettersson et al. | |
| 2012/0139670 | A1 | 6/2012 | Yamagata | |
| 2013/0000252 | A1 | 1/2013 | Pettersson et al. | |
| 2013/0045847 | A1 | 2/2013 | Capoia | |
| 2013/0130877 | A1 | 5/2013 | Su | |
| 2013/0210597 | A1 | 8/2013 | Pettersson | |
| 2013/0333538 | A1 | 12/2013 | Long et al. | |
| 2014/0091511 | A1 | 3/2014 | Martin | |
| 2014/0101929 | A1 | 4/2014 | Kim | |
| 2014/0315701 | A1 | 10/2014 | Pettersson | |
| 2014/0336026 | A1 | 11/2014 | Pettersson | |
| 2014/0357463 | A1 | 12/2014 | Kojima | |
| 2015/0018189 | A1 | 1/2015 | Pettersson et al. | |
| 2015/0019387 | A1 | 1/2015 | Pettersson | |
| 2015/0053349 | A1 | 2/2015 | Mori et al. | |
| 2015/0103923 | A1 | 4/2015 | Ramasubramonian et al. | |
| 2015/0119216 | A1* | 4/2015 | Benterman | B65B 59/02 493/22 |
| 2015/0148210 | A1 | 5/2015 | Robert | |
| 2015/0224731 | A1 | 8/2015 | Ponti | |
| 2015/0273897 | A1 | 10/2015 | Kato | |
| 2015/0360433 | A1 | 12/2015 | Feijen et al. | |
| 2015/0360801 | A1 | 12/2015 | Sytema | |
| 2016/0001441 | A1 | 1/2016 | Osterhout et al. | |
| 2016/0122044 | A1 | 5/2016 | Evers | |
| 2016/0185475 | A1 | 6/2016 | Pettersson et al. | |
| 2016/0340067 | A1 | 11/2016 | Winkler et al. | |
| 2017/0355166 | A1 | 12/2017 | Jonker | |
| 2017/0361560 | A1 | 12/2017 | Osterhout | |
| 2018/0086018 | A1* | 3/2018 | Fukuda | B31B 50/04 |
| 2018/0178476 | A1 | 6/2018 | Pettersson et al. | |
| 2018/0201465 | A1 | 7/2018 | Osterhout | |
| 2018/0265228 | A1 | 9/2018 | Hagestedt | |

FOREIGN PATENT DOCUMENTS

| | | | |
|---|---|---|---|
| CN | 1366487 | | 8/2002 |
| CN | 1876361 | | 12/2006 |
| CN | 102371705 | | 3/2012 |
| CN | 202412794 | | 9/2012 |
| CN | 102753442 | | 10/2012 |
| CN | 104169073 | | 11/2014 |
| CN | 104185538 | | 12/2014 |
| CN | 204773785 | | 11/2015 |
| CN | 106003821 | A | 10/2016 |
| CN | 107735232 | A | 2/2018 |
| CN | 108055834 | A | 5/2018 |
| DE | 1212854 | | 3/1966 |
| DE | 19541061 | | 11/1996 |
| DE | 10355544 | | 6/2005 |
| DE | 102005063193 | | 7/2007 |
| DE | 102008035278 | | 4/2010 |
| EP | 30366 | | 6/1981 |
| EP | 359005 | | 3/1990 |
| EP | 650827 | | 5/1995 |
| EP | 889779 | | 1/1999 |
| EP | 903219 | | 3/1999 |
| EP | 1065162 | | 1/2001 |
| EP | 1223107 | | 7/2002 |
| EP | 1373112 | | 1/2004 |
| EP | 1997736 | | 12/2008 |
| EP | 1497049 | | 3/2010 |
| EP | 2228206 | | 9/2010 |
| FR | 428967 | | 9/1911 |
| FR | 1020458 | | 2/1953 |
| FR | 1592372 | | 5/1970 |
| FR | 2721301 | | 12/1995 |
| FR | 2770445 | | 5/1999 |
| FR | 2808722 | | 11/2001 |
| FR | 2976561 | | 12/2012 |
| GB | 983946 | | 2/1965 |
| GB | 1362060 | | 7/1974 |
| IT | BO20100095 | A1 | 8/2011 |
| JP | S5557984 | | 4/1980 |
| JP | S5689937 | | 7/1981 |
| JP | S59176836 | | 10/1984 |
| JP | S61118720 | | 7/1986 |
| JP | H08238690 | | 9/1996 |
| JP | H08333036 | | 12/1996 |
| JP | 10-086093 | A | 4/1998 |
| JP | 2000323324 | | 11/2000 |
| JP | 2003079446 | | 3/2003 |
| JP | 2005067019 | | 3/2005 |
| JP | 2005219798 | | 8/2005 |
| JP | 2006289914 | | 10/2006 |
| JP | 2008254789 | | 10/2008 |
| JP | 2009132049 | | 6/2009 |
| JP | 2011520674 | | 7/2011 |
| JP | 2011230385 | | 11/2011 |
| RU | 2015030 | | 6/1994 |
| RU | 2004136918 | | 5/2006 |
| RU | 2398674 | | 9/2010 |
| SE | 450829 | | 8/1987 |
| SU | 1054863 | | 11/1983 |
| SU | 1718783 | | 3/1992 |
| WO | 96/16773 | A1 | 6/1996 |
| WO | 199614773 | | 6/1996 |
| WO | 1999/017923 | | 4/1999 |
| WO | 2003089163 | | 10/2003 |
| WO | 2010091043 | | 8/2010 |
| WO | 2011007237 | | 1/2011 |
| WO | 2011100078 | | 8/2011 |
| WO | 2011135433 | | 11/2011 |
| WO | 2012003167 | | 1/2012 |
| WO | 2013071073 | | 5/2013 |
| WO | 2013071080 | | 7/2013 |
| WO | 2013106180 | | 7/2013 |
| WO | 2013114057 | | 8/2013 |
| WO | 2016/176271 | | 11/2016 |
| WO | 2017/182137 | A1 | 10/2017 |
| WO | 2017203401 | | 11/2017 |

(56) References Cited

FOREIGN PATENT DOCUMENTS

| | | |
|---|---|---|
| WO | 2017218296 | 12/2017 |
| WO | 2017218297 | 12/2017 |

OTHER PUBLICATIONS

U.S. Appl. No. 62/447,714, filed Jan. 18, 2017, Osterhout.
U.S. Appl. No. 15/872,770, filed Jan. 16, 2018, Osterhout.
U.S. Appl. No. 16/310,406, filed Dec. 14, 2018, Pettersson et al.
European Search Report for EP80107577.1 dated Mar. 2, 1981.
European Search Report for EP89115688.7 dated Nov. 2, 1989.
International Search Report and Written Opinion for application No. PCT/US2010/022983 dated Apr. 13, 2010.
International Search Report for PCT/US2011/042096 dated Oct. 28, 2011.
International Search Report and Written Opinion for PCT/US2012/064414 dated Jan. 25, 2013.
European Search Report for EP10739040 dated Jan. 31, 2013.
International Search Report and Wirtten Opinion for application No. PCT/US2012/070719 dated Feb. 25, 2013.
International Search Report and Written Opinion for PCT/US2012/064403 dated Apr. 8, 2013.
European Search Report for EP12848321 dated Jul. 1, 2015.
European Search Report for EP12865028 dated Jul. 7, 2015.
International Search Report and Written Opinion for PCT/US2015/67375 dated Mar. 11, 2016.
European Search Report for EP16169030 dated Dec. 16, 2016, dated Jan. 5, 2017.
European Search Report for application No. EP17175751 dated Aug. 25, 2017.
Japanese Office Action for application No. 2017-000038 dated Sep. 22, 2017.
International Search Report and Written Opinion for application No. PCT/US2017/036603 dated Oct. 18, 2017.
International Search Report and Written Opininon for application No. PCT/US2017/036606 dated Oct. 24, 2017.
International Search Report and Written Opinion for PCT/US18/14275 dated Apr. 4, 2018.
International Search Report and Written Opinion for PCT/US2018/020928 dated Jun. 7, 2018.
International Search Report and Written Opinion PCT/IB2019/052794 dated Jun. 19, 2019.
International Search Report and Written Opinion for PCT/US2019/038142 dated Aug.2, 2019.
International Search Report and Written Opinion PCT/IB2019/052793 dated Nov. 11, 2019.
International Search Report and Written Opinion for PCT/US2019/049102 dated Dec. 2, 2019.
International Search Report and Written Opinion for PCT/US19/62696 dated Feb. 4, 2020.
U.S. Appl. No. 13/147,787, file Aug. 27, 2014, Office Action.
U.S. Appl. No. 13/147,787, filed Apr. 17, 2015, Final Office Action.
U.S. Appl. No. 13/147,787, filed Sep. 30, 2015, Office Action.
U.S. Appl. No. 13/147,787, filed Feb. 16, 2016, Final Office Action.
U.S. Appl. No. 13/147,787, filed Oct. 28, 2016, Office Action.
U.S. Appl. No. 13/147,787, filed Mar. 7, 2017, Final Office Action.
U.S. Appl. No. 13/147,787, filed Jun. 26, 2017, Notice of Allowance.
U.S. Appl. No. 13/805,602, filed Dec. 2, 2015, Office Action.
U.S. Appl. No. 13/805,602, filed Mar. 21, 2016, Notice of Allowance.
U.S. Appl. No. 14/357,183, filed Jul. 16, 2015, Office Action.
U.S. Appl. No. 14/357,183, filed Nov. 12, 2015, Final Office Action.
U.S. Appl. No. 14/357,183, filed Jan. 29, 2016, Notice of Allowance.
U.S. Appl. No. 14/370,729, filed Jan. 26, 2017, Office Action.
U.S. Appl. No. 14/370,729, filed Jul. 12, 2017, Final Office Action.
U.S. Appl. No. 14/370,729, filed Dec. 19, 2017, Office Action.
U.S. Appl. No. 14/370,729, filed May 21, 2018, Notice of Allowance.
U.S. Appl. No. 14/357,190, filed Feb. 17, 2017, Notice of Allowance.
U.S. Appl. No. 14/357,190, filed Aug. 1, 2017, Final Action.
U.S. Appl. No. 14/357,190, filed Dec. 5, 2017, Notice of Allowance.
U.S. Appl. No. 14/357,190, filed Jan. 12, 2018, Notice of Allowance.
U.S. Appl. No. 29/419,922, filed Aug. 6, 2013, Office Action.
U.S. Appl. No. 29/419,922, filed Nov. 29, 2013, Notice of Allowance.
U.S. Appl. No. 15/901,089, filed Apr. 13, 2020, Office Action.
U.S. Appl. No. 14/970,224, filed May 30, 2018, Office Action.
U.S. Appl. No. 14/970,224, filed Aug. 13, 2018, Notice of Allowance.
U.S. Appl. No. 16/109,261, filed Apr. 28, 2020, Office Action.
U.S. Appl. No. 15/616,688, filed Mar. 19, 2020, Office Action.
U.S. Appl. No. 15/872,770, filed Mar. 27, 2020, OfifceAction.

* cited by examiner

ADJUSTABLE CUTTING AND CREASING HEADS FOR CREATING ANGLED CUTS AND CREASES

CROSS-REFERENCE TO RELATED APPLICATION

The present application claims priority to and the benefit of U.S. Provisional Application No. 62/773,484, filed Nov. 30, 2018, and entitled Adjustable Cutting and Creasing Heads for Creating Angled Cuts and Creases, the entire content of which is incorporated herein by reference.

BACKGROUND

1. Technical Field

Exemplary embodiments of the disclosure relate to systems, methods, and devices for converting sheet materials. More specifically, exemplary embodiments relate to converting machines and components thereof that can make angled cuts and/or creases in paperboard, corrugated board, cardboard, and similar sheet materials.

2. The Relevant Technology

Shipping and packaging industries frequently use paperboard and other sheet material processing equipment that converts sheet materials into box templates. One advantage of such equipment is that a shipper may prepare boxes of required sizes as needed in lieu of keeping on hand a stock of standard, pre-made boxes of various sizes. Consequently, the shipper can eliminate the need to forecast its requirements for particular box sizes as well as to store pre-made boxes of standard sizes. Instead, the shipper may store one or more bales of fanfold material, which can be used to generate a variety of box sizes based on the specific box size requirements at the time of each shipment. This allows the shipper to reduce storage space normally required for periodically used shipping supplies as well as reduce the waste and costs associated with the inherently inaccurate process of forecasting box size requirements, as the items shipped and their respective dimensions vary from time to time.

In addition to reducing the inefficiencies associated with storing pre-made boxes of numerous sizes, creating custom sized boxes also reduces packaging and shipping costs. In the fulfillment industry it is estimated that shipped items are typically packaged in boxes that are about 65% larger than the shipped items. Boxes that are too large for a particular item are more expensive than a box that is custom sized for the item due to the cost of the excess material used to make the larger box. When an item is packaged in an oversized box, filling material (e.g., Styrofoam, foam peanuts, paper, air pillows, etc.) is often placed in the box to prevent the item from moving inside the box and to prevent the box from caving in when pressure is applied (e.g., when boxes are taped closed or stacked). These filling materials further increase the cost associated with packing an item in an oversized box.

Customized sized boxes also reduce the shipping costs associated with shipping items compared to shipping the items in oversized boxes. A shipping vehicle filled with boxes that are 65% larger than the packaged items is much less cost efficient to operate than a shipping vehicle filled with boxes that are custom sized to fit the packaged items. In other words, a shipping vehicle filled with custom sized packages can carry a significantly larger number of packages, which can reduce the number of shipping vehicles required to ship the same number of items. Accordingly, in addition or as an alternative to calculating shipping prices based on the weight of a package, shipping prices are often affected by the size of the shipped package. Thus, reducing the size of an item's package can reduce the price of shipping the item. Even when shipping prices are not calculated based on the size of the packages (e.g., only on the weight of the packages), using custom sized packages can reduce the shipping costs because the smaller, custom sized packages will weigh less than oversized packages due to using less packaging and filling material.

Although sheet material processing machines and related equipment can potentially alleviate the inconveniences associated with stocking standard sized shipping supplies and reduce the amount of space required for storing such shipping supplies, previously available machines and associated equipment have various drawbacks or limitations. For instance, typical box making machines have been limited in the types of box templates that can be formed therewith. By way of example, typical box making machines include cutting and/or creasing tools that form cuts or creases in only longitudinal and transverse directions (relative to the sheet material used to make the box templates) that are oriented parallel or perpendicular to one another. As a result, the machines have only been able to make box templates that require cuts and/or crease that are parallel and/or perpendicular to one another. Such machines have not been able to make angled cuts or creases (e.g., that extend diagonally across the sheet material). In order to make box templates that require angled cuts or creases, specialty machines have been required, which increase the expense associated with making boxes of various types.

Accordingly, there remains room for improvement in the area of sheet material processing machines.

BRIEF SUMMARY

Exemplary embodiments of the disclosure relate to systems, methods, and devices for converting sheet materials into boxes. More specifically, exemplary embodiments relate to converting machines and components thereof that can make angled cuts and/or creases in paperboard, corrugated board, cardboard, and similar sheet materials.

For instance, one embodiment is directed to a converting machine used to convert sheet material into packaging templates for assembly into boxes or other packaging. The converting machine includes a converting assembly configured to perform a transverse conversion function, a longitudinal conversion function, and an angled conversion function on the sheet material as the sheet material moves through the converting machine in a feed direction. The transverse conversion function, the longitudinal conversion function, and the angled conversion function are selected from the group consisting of creasing, bending, folding, perforating, cutting, and scoring, to create the packaging templates. The converting assembly includes a tool head that is selectively movable between opposing sides of the converting assembly. The tool head includes one or more converting instruments for performing the angled conversion function and at least one of the transverse conversion function or the longitudinal conversion function. An orientation of the one or more converting instruments is selectively adjustable between a default orientation and an angled orientation.

In some embodiments, the one or more converting instruments are configured to perform the angled conversion function when the one or more converting instruments are in the angled orientation. In contrast, the one or more converting instruments are configured to perform the transverse conversion function or the longitudinal conversion function when the one or more converting instruments are in the default orientation.

In some embodiments, the tool head includes a mounting block and a frame connected thereto. The one or more converting instruments are connected to the frame and the frame is adjustable about a first axis to reorient the one or more converting instruments between the default orientation and the angled orientation. The mounting block, the frame, and the one or more converting instruments can also be adjustable about a second axis to reorient the one or more converting instruments between the default orientation and the angled orientation.

The converting machine can also include a feed roller that advances the sheet material through the converting assembly. A control system that is configured to control the operation of the feed roller and the tool head can also be included. The control system can synchronize a speed of the feed roller and movements of the tool head.

In some embodiments, the angled conversion function is formed diagonally across the sheet material, while in other embodiments the angled conversion function is formed at an angle through the sheet material. In some cases, the angled conversion function includes curved cuts or creases formed in the sheet material.

The converting machine can also include a second tool head having one or more converting instruments for performing the angled conversion function and at least one of the transverse conversion function or the longitudinal conversion function. An orientation of the one or more converting instruments can be selectively adjustable between a default orientation and an angled orientation. In some cases, the tool head comprises a long head and the second tool head comprises a cross head. The one or more converting instruments of the long head can have a default orientation that is generally parallel to the feed direction of the sheet material and the one or more converting instruments of the cross head can have a default orientation that is generally perpendicular to the feed direction of the sheet material. The tool head can perform the longitudinal conversion function and the angled conversion function, and the second tool head can perform the transverse conversion function.

In other embodiments, a converting machine used to convert sheet material into packaging templates for assembly into boxes or other packaging includes a converting assembly configured to perform longitudinal conversion functions on the sheet material as the sheet material moves through the converting machine in a feed direction. The longitudinal conversion functions including at least one of creasing, bending, folding, perforating, cutting, and scoring, to create the packaging templates. The converting assembly includes a tool head selectively movable between opposing sides of the converting assembly. The tool head comprises one or more converting instruments for performing the longitudinal conversion functions. A position of the tool head is selectively adjustable in a direction generally perpendicular to the length of the sheet material and while the sheet material is advancing through the converting assembly.

These and other objects and features of the present disclosure will become more fully apparent from the following description and appended claims, or may be learned by the practice of the disclosure as set forth hereinafter.

BRIEF DESCRIPTION OF THE DRAWINGS

To further clarify the above and other advantages and features of the present invention, a more particular description of the invention will be rendered by reference to specific embodiments thereof which are illustrated in the appended drawings. It is appreciated that these drawings depict only illustrated embodiments of the invention and are therefore not to be considered limiting of its scope. The invention will be described and explained with additional specificity and detail through the use of the accompanying drawings in which.

DETAILED DESCRIPTION

The embodiments described herein generally relate to systems, methods, and devices for processing sheet materials and converting the same into packaging templates. More specifically, the described embodiments relate to converting machines or components thereof for converting sheet materials (e.g., paperboard, corrugated board, cardboard) into templates for boxes and other packaging.

While the present disclosure will describe details of embodiments with reference to specific configurations, the descriptions are illustrative and are not to be construed as limiting the scope of the present invention. Various modifications can be made to the illustrated configurations without departing from the spirit and scope of the invention as defined by the claims. For better understanding, like components have been designated by like reference numbers throughout the various accompanying figures.

As used herein, the terms "box template" and "packaging template" shall refer to a substantially flat stock of material that can be folded into a box-like shape. A box or packaging template may have notches, cutouts, divides, and/or creases that allow the box or packaging template to be bent and/or folded into a box. Additionally, a box or packaging template may be made of any suitable material, generally known to those skilled in the art. For example, cardboard or corrugated paperboard may be used as the template material. A suitable material also may have any thickness and weight that would permit it to be bent and/or folded into a box-like shape.

As used herein, the term "crease" shall refer to a line along which the sheet material or box template may fold. For example, a crease may be an indentation in the sheet material. In the case of fanfold creases, the indentation may be made by folding the sheet material into layered stacks in a bale. Other creases may be formed in the sheet material to aid in folding portions of the sheet material separated by the crease, with respect to one another, to form a box.

The terms "notch," "cutout," and "cut" are used interchangeably herein and shall refer to a shape created by removing material from the template or by separating portions of the template, such that a divide through the template is created.

Figure 1:
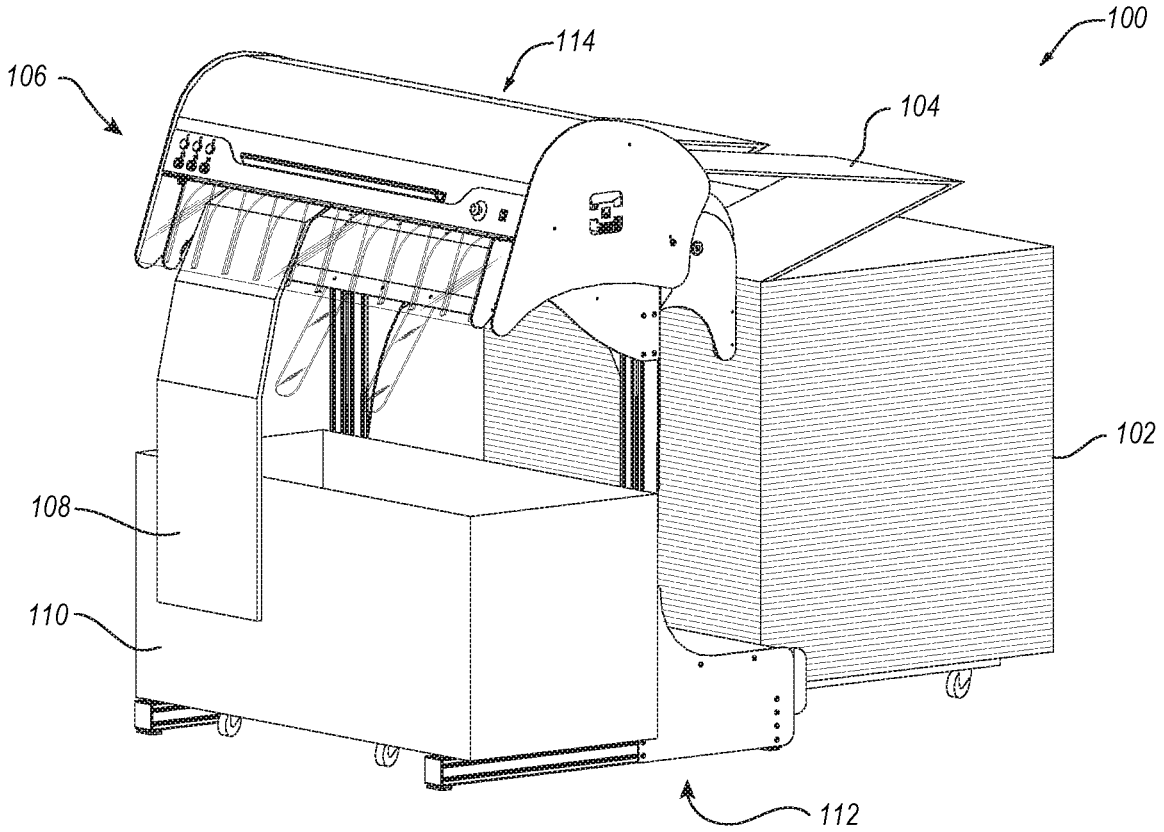
FIG. 1 illustrates a perspective view of an exemplary embodiment of a system for creating packaging templates.

FIG. 1 illustrates a perspective view of a system 100 that may be used to create packaging templates. System 100 includes one or more bales 102 of sheet material 104. System 100 also includes a converting machine 106 that performs one or more conversion functions on sheet material 104, as described in further detail below, in order to create packaging templates 108. Excess or waste sheet material 104 produced during the conversion process may be collected in a collection bin 110. After being produced, packaging templates 108 may be formed into packaging containers, such as boxes.

As illustrated in FIG. 1, converting machine 106 includes a support structure 112 and a converting assembly 114 mounted on support structure 112. Bales 102 may be disposed proximate to the backside of converting machine 106, and sheet material 104 may be fed into converting assembly 114. Sheet material 104 may be arranged in bales 102 in multiple stacked layers. The layers of sheet material 104 in each bale 102 may have generally equal lengths and widths and may be folded one on top of the other in alternating directions.

As sheet material 104 is fed through converting assembly 114, converting assembly 114 may perform one or more conversion functions (e.g., crease, bend, fold, perforate, cut, score) on sheet material 104 in order to create packaging templates 108. As shown in FIGS. 2-5 and described below, converting assembly 114 may include components that feed sheet material 104 through converting assembly 114 and perform the conversion functions thereon.

Figure 2:
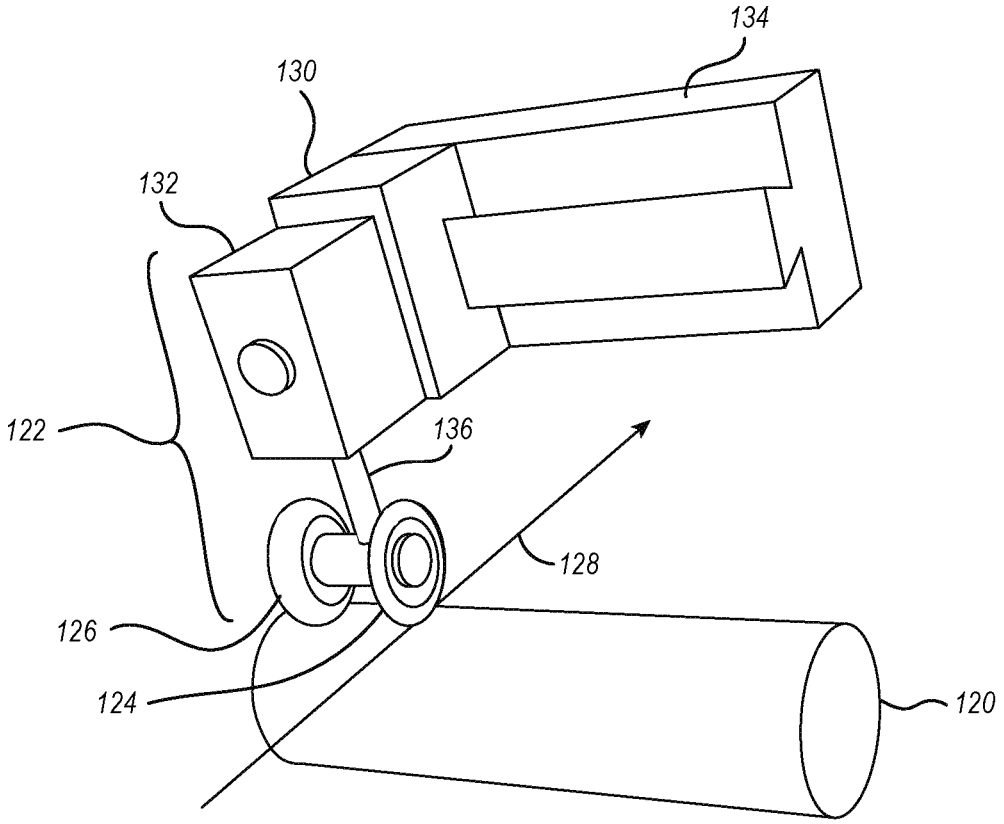
FIG. 2 illustrates a perspective view of a portion of a converting assembly from the system illustrated in FIG. 1.

For example, FIG. 2 illustrates some example components of converting assembly 114. Included in converting assembly 114 is a feed roller 120 that pulls sheet material 104 into converting assembly 114 and advances sheet material 104 therethrough. Feed roller 120 may be configured to pull sheet material 104 with limited or no slip and may be smooth, textured, dimpled, and/or teethed. Feed roller 120 may be actively rolled by an actuator or motor in order to advance sheet material 104 through converting assembly 114. While FIG. 2 illustrates a single feed roller, it will be appreciated that converting assembly 114 may include multiple feed rollers.

As also illustrated in FIG. 2, converting assembly 114 also includes a tool head 122. In some embodiments, tool head 122 may also be referred to as long head 122. Tool head 122 is configured to perform the conversion functions (e.g., crease, bend, fold, perforate, cut, score) on sheet material 104 in order to create packaging templates 108 therefrom. To enable tool head 122 to be able to perform the conversion functions, tool head 122 includes a cutting wheel 124 and a creasing wheel 126. In other embodiments, a tool head may only include a cutting wheel 124 (and not a creasing wheel 126) or a creasing wheel 126 (and not a cutting wheel 124). In still other embodiments, a tool head may include one or more cutting wheels and creasing wheels. In yet other embodiments, converting assembly 114 may include separate tool heads for cutting wheel(s) 124 and creasing wheel(s) 126.

Cutting and/or creasing wheels 124, 126 may be selectively positioned to engage sheet material 104 as sheet material 104 advances through converting assembly 114 in order to perform the conversion functions thereon. For instance, in some embodiments, tool head 122 enables cutting and/or creasing wheels 124, 126 to be raised and lowered (relative to feed roller 120) to disengage and engage sheet material 104. In the illustrated embodiment, tool head 122 is positioned relative to feed roller 120 so that sheet material 104 advances between feed roller 120 and cutting and creasing wheels 124, 126. Feed roller 104 may also support sheet material 104 while tool head 122 performs the conversion functions thereon. In other embodiments, converting assembly 114 may include a support surface (separate from feed roller 134) for supporting sheet material 104 while conversion functions are performed thereon.

In the default position shown in FIG. 2, cutting and creasing wheels 124, 126 are oriented parallel to the feed direction of sheet material 104. The feed direction of sheet material 104 is illustrated by arrow 128. In this orientation, conversion functions may be made on sheet material 104 in a direction substantially parallel to the direction of movement and/or the length of sheet material 104. Conversions made along the length of and/or generally parallel to the direction of movement of sheet material 104 may be considered "longitudinal conversions."

Tool head 122 may be used to create the longitudinal conversions on sheet material 104. More specifically, tool head 122 may be selectively repositioned along the width of converting assembly 114 (e.g., back and forth in a direction that is perpendicular to the length of sheet material 104) in order to properly position tool head 122 relative to the sides of sheet material 104. By way of example, if a longitudinal crease or cut needs to be made two inches from one edge of sheet material 104 (e.g., to trim excess material off of the edge of sheet material 104), tool head 122 may be moved perpendicularly across sheet material 104 to properly position cutting wheel 124 and/or creasing wheel 126 so as to be able to make the cut or crease at the desired location. In other words, tool head 122 may be moved transversely across sheet material 104 to position tool head 122 at the proper locations to make the longitudinal conversions on sheet material 104.

In addition to being able to be positioned at a desired location in order to perform a conversion function at a desired location on sheet material 104, the position of tool head 122 may also be adjusted while sheet material 104 is being advanced through converting assembly 114. By way of example, tool head 122 may be moved so that creasing wheel 126 can perform a creasing function at a predetermined location on sheet material 104. After creasing wheel 126 has performed the creasing function at the predetermined location and along a predetermined length of sheet material, the position of tool head 122 may be adjusted so that creasing wheel 126 can perform a creasing function on a different predetermined location and along a second length of sheet material 104. Similarly, the position of tool head 122 may be adjusted while the sheet material 104 is being advanced through the converting assembly 114 so as to enable the cutting wheel 124 to form offset cuts along different lengths of the sheet material 104.

In some embodiments, the positional adjustment of tool head 122 may be made while sheet material 104 is still being advanced through converting assembly 114. For instance, the positional adjustment to tool head 122 may be made while the sheet material is moving or continuously moving through the converting assembly 114. Additionally, the positional adjustments of tool head 122 may be made while cutting wheel 124 and/or creasing wheel 126 are in the default orientation shown in FIG. 2 (e.g., oriented parallel to the length of sheet material 104).

The length of such positional adjustments may correspond to a thickness of one or more layers of sheet material 104. In some embodiments, for instance, creasing wheel 126 may be positioned to perform a creasing function at a first position along a first length of sheet material 104. Thereafter, the position of creasing wheel 126 may be adjusted a distance that corresponds to the thickness of, for example, one or two layers of sheet material 104. At the adjusted position, creasing wheel 126 may be positioned to perform a creasing function at a second position along a second length of sheet material 104. The creases formed at the first and second positions may facilitate folding of the resulting box template into a completed box. For instance, the offset creases may allow one panel or flap of the resulting box template to be folded either inside or outside of another panel or flap of the box template when forming a box therefrom.

To enable tool head 122 to move transversely across sheet material 104, a carriage 130 is connected to a mounting block 132 of tool head 122. Carriage 130 is slidably connected to a track 134. Track 134 is oriented transverse (i.e., perpendicular) to the feed direction 128 of sheet material 104. As a result, when carriage 130 moves along the length of track 134, tool head 122 is transversely repositioned along the width of sheet material 104.

In addition to being able to make longitudinal conversions, tool head 122 may be configured to make angled conversions in sheet material 104. By way of example, cutting wheel 124 and/or creasing wheel 126 may be mounted on a frame 136 that can rotate so that the orientation of cutting wheel 124 and/or creasing wheel 126 can be adjusted. Rotation of frame 136 can enable cutting wheel 124 and/or creasing wheel 126 to be oriented at a non-parallel angle relative to feed direction 128.

Figure 3:
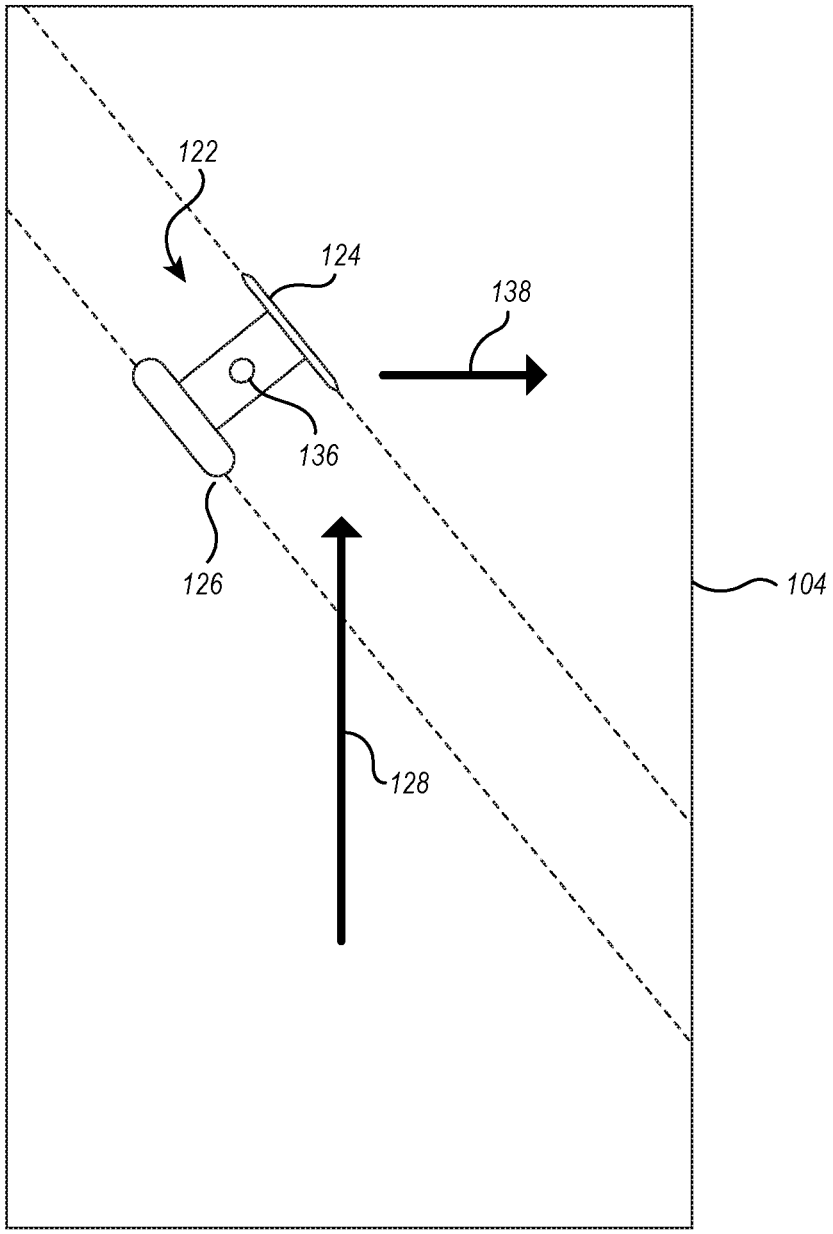
FIG. 3 is partial top view of a tool head performing angled conversion functions on sheet material.

FIG. 3 illustrates a plan view of sheet material 104 and cutting and creasing wheels 124, 126. As can be seen, cutting and creasing wheels 124, 126 have been rotated about an axis of frame 136. As a result, cutting and creasing wheels 124, 126 are oriented at an angle (e.g., not parallel) relative to feed direction 128 of sheet material 104. When cutting and/or creasing wheels 124, 126 are so angled, cutting and/or creasing wheels 124, 126 can perform conversion functions that are angled across on sheet material 104.

In order for cutting and/or creasing wheels 124, 126 to perform the angled conversion functions, sheet material 104 is advanced through converting assembly 114 and tool head 122 is simultaneously moved transversely across sheet material 104. The combined movements of sheet material 104 in feed direction 128 and tool head 122 transverse thereto (e.g., in the direction of arrow 138), as well as the angled orientation of cutting and/or creasing wheels 124, 126, enables angled conversions (illustrated in FIG. 3 with dashed lines) to be performed on sheet material 104.

FIG. 3 illustrates cutting and/or creasing wheels 124, 126 angled in a first direction and tool head 122 moving in the direction of arrow 138 so as to perform a conversion function in a first diagonal direction. It will be understood that cutting and/or creasing wheels 124, 126 can be angle in an opposite direction and tool head 122 can move in a direction opposite to arrow 138 so as to perform a conversion function in a second diagonal direction. Furthermore, it will be appreciated that cutting and/or creasing wheels 124, 126 can be angled at substantially any angle relative to feed direction 128 so as to perform conversion functions at substantially any angle across sheet material 104.

Figure 4:
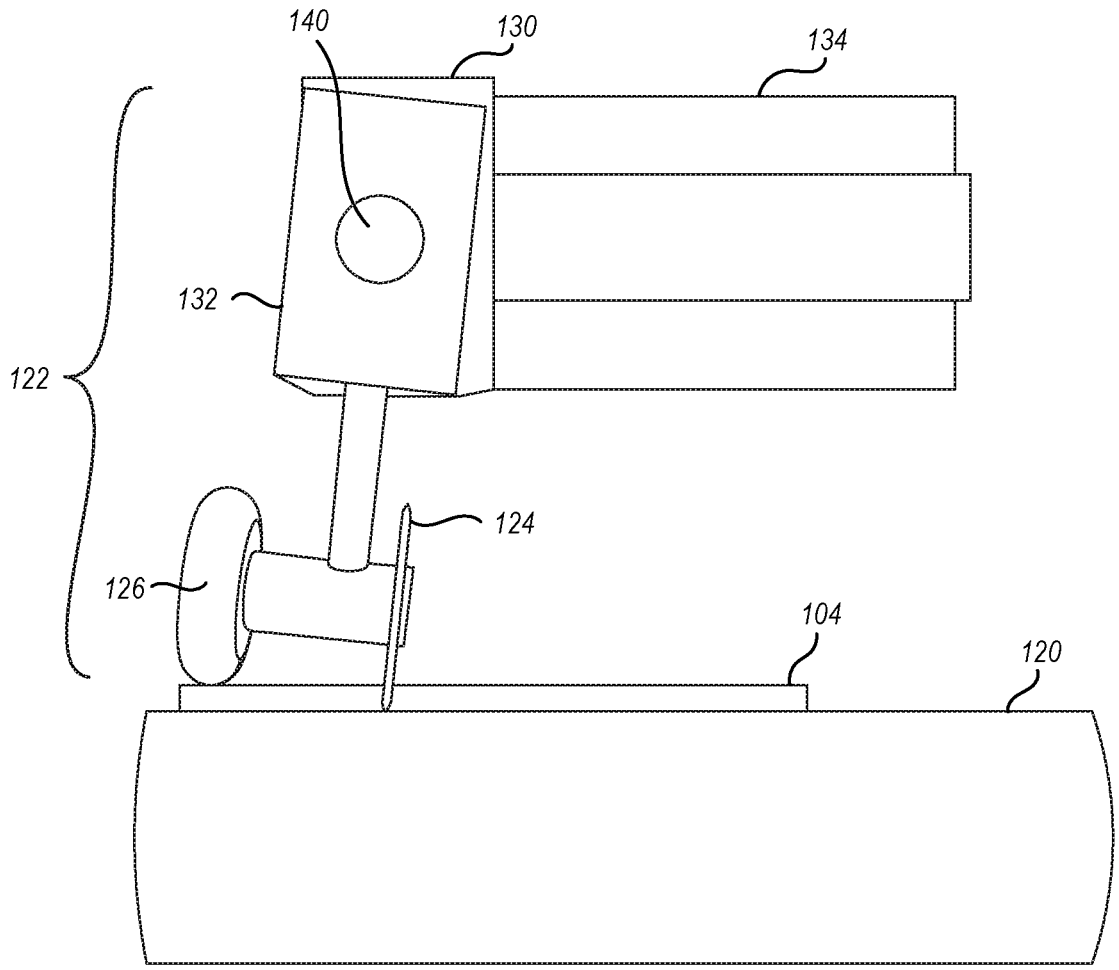
FIG. 4 illustrates a tool head performing an angled conversion function on sheet material.

While FIG. 3 illustrates cutting and creasing wheels 124, 126 being angled to enable angled conversions across sheet material 104, tool head 122 may also be configured to enable angled conversions through sheet material 104. By way of example, tool head 122 (or portions thereof) may rotate around pin 140 so as to angle cutting and/or creasing wheels 124, 126 relative to a planar surface of sheet material 104. As shown in FIG. 4, for instance, tool head 122 is rotated about pin 140 so that cutting wheel 124 cuts through sheet material 104 at an angle. More specifically, cutting wheel 124 is angled so that the resulting cut through sheet material 104 is angled between the opposing planar faces of sheet material 104. It will be appreciated that the direction and degree of the conversion function can vary between substantially any direction and/or degree.

While FIGS. 2-4 and the foregoing description have disclosed a single tool head that can be adjusted to perform various angled conversions on sheet material 104, it will be appreciated that converting assembly 114 may include a plurality of such tool heads. It will also be appreciated that converting assembly 114 may include multiple adjustable tool heads. For instance, a converting assembly may include one or more adjustable tool heads than can perform angled conversions in a first direction or orientation and one or more other adjustable tool heads that can perform angled conversions in a second direction or orientation.

Figure 5:
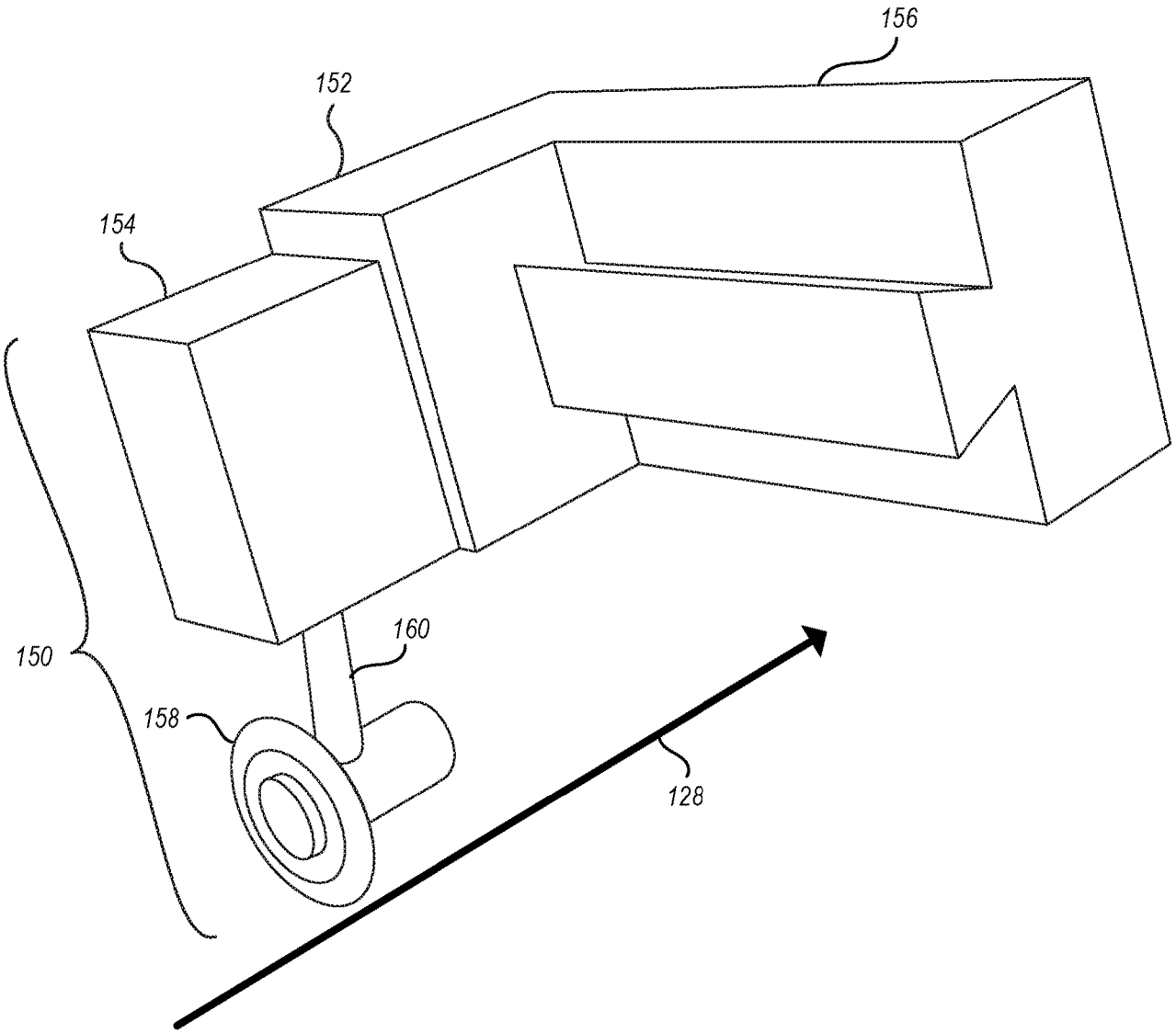
FIG. 5 illustrates a perspective view of another portion of the converting assembly from the system illustrated in FIG. 1.

Furthermore, FIGS. 2-4 and the foregoing description have focused on a tool head that can perform both longitudinal conversions and can be reoriented to perform angled conversions across and/or through sheet material 104. As noted above, such a tool head may also be referred to as a long head since it performs longitudinal conversions. As illustrated in FIG. 5, converting assembly 114 may also include one or more tool heads 150 that can perform both "transverse conversions" and can be reoriented to perform angled conversions across and/or through sheet material 104. Such a tool head 150 may also be referred to as cross head 150 since it performs transverse conversions across sheet material 104 (e.g., conversion functions performed in a direction substantially perpendicular to the direction of movement and/or the length of sheet material 104).

To perform the transverse conversions, tool head 150 may move along at least a portion of the width of converting assembly 114 in a direction generally perpendicular to feed direction 128 (the direction in which sheet material 104 is fed through converting assembly 114 and/or the length of sheet material 104). In other words, tool head 150 may move across sheet material 104 in order to perform transverse conversions on sheet material 104.

To enable tool head 150 to move transversely across sheet material 104, a carriage 152 is connected to a mounting block 154 of tool head 150. Carriage 152 is slidably connected to a track 156. Track 156 is oriented transverse (i.e., perpendicular) to the feed direction 128 of sheet material 104. As a result, when carriage 152 moves along the length of track 156, tool head 152 moves transversely across sheet material 104.

Tool head 150 may include one or more converting instruments, such as a cutting wheel 158 and/or a creasing wheel, which may perform one or more transverse conversions on sheet material 104. For example, as tool head 150 moves back and forth over sheet material 104, cutting wheel 158 and/or a creasing wheel may create creases, bends, folds, perforations, cuts, and/or scores in sheet material 104.

In addition to being able to move transversely across sheet material 104 in order to perform transverse conversion functions at a desired location on sheet material 104, the sheet material 104 may be incrementally advanced through the converting assembly 114 while tool head 150 is moved transversely across sheet material 104. By way of example, tool head 150 may be moved across sheet material 104 so that cutting wheel 158 forms a transverse cut at a desired location in sheet material 104. After tool head 150 has performed the conversion function at the predetermined location and along a predetermined width of sheet material 104, sheet material 104 may be adjusted (e.g., incrementally advanced through the converting assembly 114) so that tool head 150 can perform a conversion function on a different predetermined location and along a second width of sheet material 104.

In some embodiments, the incremental advancement of sheet material 104 may be made while tool head 105 is still moving across sheet material 104. For instance, the incremental advancement of sheet material 104 may be made while tool head 105 is moving or continuously moving across sheet material 104. Additionally, the incremental advancement of sheet material 104 may be made while cutting wheel 58 and/or a creasing wheel is in the default orientation shown in FIG. 5 (e.g., oriented perpendicular to the length of sheet material 104).

The length of such incremental advancements of sheet material 104 may correspond to a thickness of one or more layers of sheet material 104. In some embodiments, for instance, sheet material 104 may be positioned so that cutting wheel 158 and/or a creasing wheel can perform a conversion function at a first position along a first width of sheet material 104. Thereafter, sheet material 104 may be incrementally advanced a distance that corresponds to the thickness of, for example, one or two layers of sheet material 104. With the sheet material 104 in the incrementally advanced position, cutting wheel 158 and/or a creasing wheel may continue to advance across sheet material 104 to perform a conversion function at a second position along a second width of sheet material 104.

Similar to tool head 122, tool head 150 can be configured so that the orientation of cutting wheel 158 and/or a creasing wheel can be selectively adjusted. By way of example, cutting wheel 158 and/or a creasing wheel may be mounted on a frame 160 that can rotate so that the orientation of cutting wheel 158 and/or a creasing wheel can be adjusted. Rotation of frame 160 can enable cutting wheel 158 and/or a creasing wheel to be oriented at a non-perpendicular angle relative to feed direction 128. When cutting wheel 158 and/or a creasing wheel is oriented at a non-perpendicular angle relative to feed direction 128, cutting wheel 158 and/or a creasing wheel can perform angled conversion functions on sheet material 104.

In order for cutting wheel 158 and/or a creasing wheel to perform the angled conversion functions, sheet material 104 is advanced through converting assembly 114 and tool head 150 is simultaneously moved transversely across sheet material 104. The combined movements of sheet material 104 in feed direction 128 and tool head 150 transverse thereto (e.g., perpendicular to feed direction 128), as well as the angled orientation of cutting wheel 158 and/or a creasing wheel, enables angled conversions to be performed on sheet material 104.

Although not illustrated in FIG. 5, tool head 150 (or portions thereof) may also be adjustable to enable cutting wheel 158 to perform angled cuts through sheet material 104, similar to the discussion of the embodiment shown in FIG. 4.

The orientation of the various tool heads and/or converting instruments thereof (e.g., cutting wheels, creasing wheels, etc.) may be adjusted on the fly (e.g., as conversion functions are being performed). On the fly adjustments to these components can increase the speed at which the conversion functions are performed, thereby reducing or eliminating the need to stop the feeding of the sheet material while adjustments are made. Furthermore, the adjustability of the noted components can enable diagonal and/or curved conversions to be made in the sheet material. Such capability can allow for a wider range of box templates to be formed and/or for additional functionality to be incorporated in the boxes formed with the box templates.

The converting instruments (e.g., cutting wheels, creasing wheels, etc.) described herein may be passive or active. For instance, a cutting or creasing wheel may freely rotate as the sheet material is advanced thereby. In other cases, a cutting wheel or creasing wheel may be actively driven (e.g., with a motor or other actuator). Additionally, the tool heads may include actuators, motors, gears, etc. to reorient the converting instruments to the desired angle.

A control system can control the operation of the converting machine 106. More specifically, the control system can control the movement and/or placement of the various components of the converting machine 106. For instance, the control system can control the rotational speed and/or direction of the feed rollers 134 in order to govern the direction (i.e., forward or backward) the sheet material 104 is fed and/or the speed at which the sheet material 104 is fed through the converting machine 106. The control system can also govern the positioning and/or movement of the tool heads 122, 150, including the orientation of cutting wheels 124, creasing wheels 126, and cutting wheels 158, so that the tool heads 122, 150 perform the conversion functions in the desired orientations and on the desired locations of the sheet material 104. The control system can also synchronize the operations of the feed rollers 134 (e.g., speed and direction), tool heads 122, 150 (position, movement, and direction), and the orientation of the cutting wheels 124, creasing wheels 126, and cutting wheels 158 so that the desired conversion functions are performed.

The control system may be incorporated into converting machine 106. In other embodiments, converting machine 106 may be connected to and in communication with a separate control system, such as a computer, that controls the operation of converting machine 106. In still other embodiments, portions of the control system may be incorporated into converting machine 106 while other portions of the control system are separate from converting machine 106. Furthermore, the control system may include hardware components, software components, or combinations thereof. Regardless of the specific configuration of the control system, the control system can control the operations of converting machine 106 that form box templates 108 out of sheet material 104.

It will be appreciated that relative terms such as "horizontal," "vertical," "upper," "lower," "raised," "lowered," "above," "below" and the like, are used herein simply by way of convenience. Such relative terms are not intended to limit the scope of the present invention. Rather, it will be appreciated that the components described herein may be configured and arranged such that these relative terms require adjustment.

The present invention may be embodied in other specific forms without departing from its spirit or essential characteristics. Thus, the described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

What is claimed is:

1. A converting machine used to convert sheet material into packaging templates for assembly into boxes or other packaging, the converting machine comprising:

a converting assembly configured to perform a transverse conversion function, a longitudinal conversion function, and an angled conversion function on the sheet material as the sheet material moves through the converting machine in a feed direction, the transverse conversion function, the longitudinal conversion function, and the angled conversion function being selected from the group consisting of creasing, bending, folding, perforating, cutting, and scoring, to create the packaging templates, the converting assembly comprising:

a tool head selectively movable between opposing sides of the converting assembly, the tool head comprising a mounting block, a frame connected to the mounting block, and one or more converting instruments connected to the frame, the two or more converting instruments being configured to perform the angled conversion functions and at least one of the transverse conversion function or the longitudinal conversion function, an orientation of the two or more converting instruments being selectively adjustable about a first axis between a default orientation and an angled orientation, the default orientation being either parallel or perpendicular to the feed direction of the sheet material and the angled orientation being neither parallel nor perpendicular to the feed direction of the sheet material, the first axis being oriented in a first direction, and the mounting block being rotatable about a second axis, the second axis being oriented in a second direction that is different from the first direction, whereby the two or more converting instruments are movable about both the first and second axes.

2. The converting machine of claim 1, wherein the two or more converting instruments are configured to perform the angled conversion function when the two or more converting instruments are in the angled orientation.

3. The converting machine of claim 1, wherein the two or more converting instruments are configured to perform the transverse conversion function or the longitudinal conversion function when the two or more converting instruments are in the default orientation.

4. The converting machine of claim 1, wherein the two or more converting instruments comprise a cutting tool and a creasing tool connected frame, such that adjustment about the first axis changes the orientation of both the cutting tool and the creasing tool.

5. The converting machine of claim 1, wherein rotation of the mounting block about the second axis causes at least one of the two or more conversion tools to engage with or disengage from the sheet material.

6. The converting machine of claim 5, wherein the two or more converting instruments comprise a cutting tool, and wherein rotation of the mounting block about the second axis is configured to cause the cutting tool to pass through the sheet material at an angle between opposing major surfaces of the sheet material.

7. The converting machine of claim 1, further comprising a feed roller that is configured to advance the sheet material through the converting assembly.

8. The converting machine of claim 7, further comprising a control system that is configured to control the operation of the feed roller and the tool head.

9. The converting machine of claim 8, wherein the control system synchronizes a speed of the feed roller and movements of the tool head.

10. The converting machine of claim 1, wherein the two or more converting instruments comprise a cutting wheel or a creasing wheel.

11. The converting machine of claim 1, wherein, in the default orientation, the two or more converting instruments are generally parallel to the feed direction of the sheet material.

12. The converting machine of claim 1, wherein, in the default orientation, the two or more converting instruments are generally perpendicular to the feed direction of the sheet material.

13. The converting machine of claim 1, further comprising a carriage connected to the tool head and a track, the carriage being slidable along the track to move the tool head.

14. The converting machine of claim 1, wherein the angled conversion function is formed diagonally across the sheet material.

15. The converting machine of claim 1, wherein angled conversion function is formed at an angle through the sheet material.

16. The converting machine of claim 1, wherein the angled conversion function comprises curved cuts or creases formed in the sheet material.

17. A converting machine used to convert sheet material into packaging templates for assembly into boxes or other packaging, the converting machine comprising:

a converting assembly configured to perform a transverse conversion function, a longitudinal conversion function, and an angled conversion function on the sheet material as the sheet material moves through the converting machine in a feed direction, the transverse conversion function, the longitudinal conversion function, and the angled conversion function being selected from the group consisting of creasing, bending, folding, perforating, cutting, and scoring, to create the packaging templates, the converting assembly comprising:

a first tool head selectively movable between opposing sides of the converting assembly, the tool head comprising a mounting block, a frame connected to the mounting block, and one or more converting instruments connected to the frame, the one or more converting instruments being configured to perform the angled conversion functions and at least one of the transverse conversion function or the longitudinal conversion function, an orientation of the one or more converting instruments being selectively adjustable about a first axis between a default orientation and an angled orientation, the default orientation being either parallel or perpendicular to the feed direction of the sheet material and the angled orientation is neither parallel nor perpendicular to the feed direction of the sheet material, the first axis being oriented in a first direction, and the mounting block being rotatable about a second axis, the second axis being oriented in a second direction that is different from the first direction; and a second tool head comprising a mounting block, a frame connected to the mounting block, a cutting tool, and a creasing tool, both the cutting tool and the creasing tool being connected to the frame, the frame being movably connected to the mounting block such that movement of the frame about a first axis simultaneously changes an orientation of both the cutting tool and the creasing tool relative to the feed direction, the cutting tool and the creasing tool being configured to perform the angled conversion functions and at least one of the transverse conversion function or the longitudinal conversion function.

18. The converting machine of claim 17, wherein an orientation of the cutting tool and the creasing tool is selectively adjustable between a default orientation and an angled orientation, wherein the default orientation of the cutting tool and the creasing tool of the second tool holder is either parallel or perpendicular to the feed direction of the sheet material and the angled orientation is neither parallel nor perpendicular to the feed direction of the sheet material.

19. The converting machine of claim 18, wherein, in the default orientations, the one or more converting instruments of the long head are generally parallel to the feed direction of the sheet material and the cutting tool and the creasing tool of the second tool head are generally perpendicular to the feed direction of the sheet material.

20. The converting machine of claim 19, wherein the first tool head performs the longitudinal conversion function and the angled conversion function, and the second tool head performs the transverse conversion function.

21. The converting machine of claim 17, wherein, when the one or more converting instruments of the first tool head are in the default orientation, a position of the first tool head is selectively adjustable in a direction generally transverse to the length of the sheet material and while the sheet material is advancing through the converting assembly.

22. A converting machine used to convert sheet material into packaging templates for assembly into boxes or other packaging, the converting machine comprising:

a converting assembly configured to perform longitudinal conversion functions on the sheet material as the sheet material moves through the converting machine in a feed direction, the longitudinal conversion functions including at least one of creasing, bending, folding, perforating, cutting, and scoring, to create the packaging templates, the converting assembly comprising:

a tool head selectively movable between opposing sides of the converting assembly, the tool head comprising a mounting block, a frame connected to the mounting block, a cutting tool, and a creasing tool, both the cutting tool and the creasing tool being connected to the frame, the frame being movably connected to the mounting block such that movement of the frame about a first axis simultaneously changes an orientation of both the cutting tool and the creasing tool relative to the feed direction, the cutting tool and the creasing tool being configured to perform the longitudinal conversion functions.

23. The converting machine of claim 22, wherein the mounting block is selectively rotatable about a second axis that is oriented in a different direction than the first axis, wherein rotation of the mounting block is configured to cause at least one of the one or more conversion tools to engage with or disengage from the sheet material.

24. The converting machine of claim 22, wherein the cutting tool and the creasing tool each have a default orientation in which the tool is generally parallel to the feed direction of the sheet material to perform the longitudinal conversion functions generally parallel to the feed direction of the sheet material.

25. The converting machine of claim 24, wherein the cutting tool and the creasing tool are selectively adjustable from the default orientation to an angled orientation to perform one or more angled conversion functions on the sheet material.

26. The converting machine of claim 25, wherein, in the angled orientation, the cutting tool and the creasing tool are oriented at a non-parallel and non-perpendicular angle relative to the feed direction of the sheet material.

27. The converting machine of claim 22, wherein the position of the tool head is selectively adjustable in a direction generally perpendicular to the length of the sheet material and while the sheet material is continuously moving through the converting assembly.

28. The converting machine of claim 22, further comprising a second tool head having one or more converting instruments for performing one or more transverse conversion functions.

29. The converting machine of claim 28, wherein the converting assembly is configured to incrementally advance the sheet material therethrough as the one or more converting instruments of the second tool head perform the one or more conversion functions on the sheet material.

* * * * *